US008626027B2

(12) United States Patent
Sugaya et al.

(10) Patent No.: US 8,626,027 B2
(45) Date of Patent: Jan. 7, 2014

(54) IMAGE HEATING APPARATUS

(75) Inventors: Kenjirou Sugaya, Moriya (JP); Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 13/316,855

(22) Filed: Dec. 12, 2011

(65) Prior Publication Data

US 2012/0148318 A1 Jun. 14, 2012

(30) Foreign Application Priority Data

Dec. 14, 2010 (JP) ..... 2010-278187

(51) Int. Cl.
*G03G 15/20* (2006.01)

(52) U.S. Cl.
USPC ..... 399/122; 399/329

(58) Field of Classification Search
USPC ..... 399/329, 122, 328, 330
See application file for complete search history.

(56) References Cited

U.S. PATENT DOCUMENTS

| | | | |
|---|---|---|---|
| 7,609,991 | B2 | 10/2009 | Koshida |
| 8,055,175 | B2 | 11/2011 | Sugaya |
| 2008/0267676 | A1 | 10/2008 | Takai et al. |
| 2010/0150621 | A1 | 6/2010 | Sugaya |
| 2010/0178088 | A1 | 7/2010 | Koshida et al. |
| 2010/0202809 | A1 | 8/2010 | Shinshi et al. |
| 2011/0076070 | A1 | 3/2011 | Koshida |
| 2011/0150546 | A1 | 6/2011 | Koshida |
| 2012/0148304 | A1 | 6/2012 | Sugaya et al. |
| 2012/0155934 | A1 | 6/2012 | Takeuchi et al. |

FOREIGN PATENT DOCUMENTS

| | | | |
|---|---|---|---|
| JP | 2000-187406 | A | 7/2000 |
| JP | 2006-78933 | A | 3/2006 |
| JP | 2008-277297 | A | 11/2008 |
| JP | 2010-181821 | A | 8/2010 |
| JP | 2010-230820 | A | 10/2010 |
| JP | 2010-262045 | A | 11/2010 |

OTHER PUBLICATIONS

Machine translation of JP 2010230820.*

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image heating apparatus includes: an excitation coil; an image heating member for generating heat using a magnetic flux from the excitation coil to heat an image on a recording material; a magnetic core; image heating member; a core supporting member; magnetic core; a back-up member; a pressing member forming a nip between the back-up member and itself with the image heating member therebetween; a stay member; an apparatus side plate; a first positioning portion for determining a position of the stay member relative to one of the apparatus side plates; and a second positioning portion, provided at a central portion of the stay member, for determining a position of the core supporting member relative to the stay member.

13 Claims, 13 Drawing Sheets

IMAGE HEATING APPARATUS

FIELD OF THE INVENTION AND RELATED ART

The present invention relates to an image heating apparatus employed by an image forming apparatus such as a copying machine, a printer, a facsimile machine, and the like. As examples of an image heating apparatus, an apparatus for fixing an unfixed image formed on a recording medium, an apparatus for heating a fixed image on a recording medium to increase the glossiness of an image, and the like can be listed.

Generally speaking, an image forming apparatus which uses powdery toner forms an unfixed toner image on a recording medium. Thus, it has to fix the unfixed toner image. Therefore, in the field of an image forming apparatus which uses powdery toner, it is common practice to employ an image heating apparatus as a fixing device to fix an unfixed toner image to a recording medium. As for the process through which an unfixed toner image is fixed by an image heating device (fixing device), it is as follows: After the formation of an unfixed toner image by an image forming apparatus, the unfixed toner image is electrostatically transferred onto the surface of a sheet of a recording medium. Then, the sheet of the recording medium, on which the transferred unfixed toner image is present, is conveyed through the fixing device of the image forming apparatus so that it remains pinched between the heating member and the pressure applying member of the fixing device. As the sheet is conveyed through the fixing device, the unfixed toner image is thermally fixed to the sheet by the heat and pressure applied by the heating member and the pressure applying member of the fixing device. As the means for thermally fixing an unfixed toner image, a rotational member such as a roller, an endless belt, and the like are employed.

As an example of a fixing device which employs a rotational member, such as the one described above, as a heating means, there is the fixing device disclosed in Japanese Laid-open Patent Application 2000-187406. In the case of this fixing device, its rotational heating member is provided with an electrically conductive surface layer, in which heat can be generated by electromagnetic induction. More specifically, in the case of a fixing device such as the abovementioned one, an alternating magnetic field is generated by causing high frequency current to flow through an excitation coil. As an alternating magnetic field is generated, the magnetic flux is guided by a magnetic flux passage formed of a magnetic substance so that it penetrates the electrically conductive layer of the rotational member. As the magnetic flux penetrates the electrically conductive layer, it generates eddy currents in the electrically conductive layer. Consequently, heat is generated in the electrically conductive layer by the eddy current (Joule Effect), and the rotational member is heated by thus heat.

Thus, the portions of the rotational member, through which a greater amount of the magnetic flux penetrates, generate more heat than the portions of the rotational member through which a lesser amount of the magnetic flux penetrates. Thus, the rotational member can be made uniform in heat generation in terms of the direction parallel to its rotational axis (lengthwise direction), by placing the magnetic substance across the entire range of the rotational member in terms of the lengthwise direction.

Japanese Laid-open Patent Application 2006-078933 discloses another example of the above-described type. In the case of this fixing device, a magnetic substance is within the hollow of the rotational member (member to be heated) to control the rotational member in temperature. In a fixing device such as the one in this patent application, the magnetic substance is solidly held by a supporting member so that a preset distance is maintained between the magnetic substance and the rotational member (member to be heated).

At this time, referring to FIGS. 15 and 16, the prior art regarding the positioning of the various components of a fixing device in terms of the direction perpendicular to the recording-medium-conveyance direction is described. FIGS. 15 and 16 are vertical sectional views of the fixing device 5 in accordance with the present invention, at a plane parallel to the lengthwise direction of the device 5. The fixing device 5 is provided with a pressure roller 105, a fixation belt unit 110, and a pair of side plates 55. The fixation belt unit 110 is supported by the pair of side plates 55, which are at the lengthwise ends of the device 5, one for one. More concretely, the supporting portion 103*a* of each of the two flanges 103 of the fixation belt unit 110 is in engagement with the corresponding side plate 55.

The fixation belt unit 110 is made up of a stay 104, a magnetic core 106, and a supporting member 107. The stay 104 and the magnetic core 106 extend from one lengthwise ends of the fixation belt unit 110 to the other, and are supported by the core supporting member 107. The position of the flange 103 is under the control of the core supporting member positioning portion 103*c* of the flange 103. Thus, the positional referential point for the stay 104 and the core supporting member 107 in terms of the lengthwise direction is the lengthwise end A (left end in drawings).

However, a fixing apparatus which employs an inductive heating method such as the one described above suffers from the following problems. That is, in order for a fixing device to meet the low-energy-consumption requirement, its fixing member has to be very small in thermal capacity. Thus, as a fixing device that satisfies the low-energy-consumption requirement is started, its fixing member virtually instantly increases in surface temperature, becoming ready for fixation. In comparison, its magnetic core supporting member, which is formed of resinous substance, remains relative low in temperature when the fixing device is started for a job. However, if the job started happens to be a long continuous job, the core supporting member gradually increases in temperature with the continuation of the job. Further, the core supporting member is on the inward side of the loop which the fixation belt forms, and is in the adjacencies of the inward surface of the fixation belt. Therefore, its temperature increase is substantially greater than the temperature increase of the ambience of the outward side of the fixing member.

Referring to FIG. 16, as the core supporting member 107 increases in temperature, it expands in the direction (lengthwise direction) perpendicular to the recording-medium-conveyance direction (by ΔL). As for the magnetic core 106, it is positioned so that its left and right portions are symmetrical with reference to the center line of the recording-medium conveyance passage before the fixation belt is heated. However, as a job continues, in particular, if the job happens to be a long one, the left and right portions of the magnetic core 106 become different in dimension (length), because of the thermal expansion of the core supporting member 107 (QR and QL, PR and PL).

As a result, one side of the fixing member, relative to the center line of the recording-medium conveyance passage, becomes different from the other side, in terms of the gap between the magnetic core 106 and the coil, and therefore, one side of the fixing member becomes different in temperature distribution from the other side, which is problematic.

SUMMARY OF THE INVENTION

Thus, the primary object of the present invention is to provide an image heating apparatus that has a significantly smaller temperature difference between one side of its fixing member and the other side with reference to the center line of its recording-medium conveyance passage, than any image heating apparatus in accordance with the prior art.

According to an aspect of the present invention, there is provided an image heating apparatus comprising an excitation coil; an image heating member for generating heat using a magnetic flux from the excitation coil to heat an image on a recording material; a magnetic core provided inside the image heating member for guiding the magnetic flux to the image heating member; a core supporting member of resin material contacting the magnetic core to support the magnetic core; a back-up member contacting an inner surface of the image heating member; a pressing member forming a nip between the back-up member and itself with the image heating member therebetween; a stay member of metal, provided inside the image heating member, for pressing the back-up member to form a nip; an apparatus side plate provided at each of opposite ends with respect to a rotational axis direction of the image heating member; a first positioning portion for determining a position of the stay member relative to one of the apparatus side plates; and a second positioning portion, provided at a central portion of the stay member, for determining a position of the core supporting member relative to the stay member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described with reference to the appended drawings, in which a component, its portions, etc., in the second to fourth embodiments are the same in structure as the counterparts in the first embodiment, they are given the same referential codes as those given to the counterparts.

Embodiment 1

(Image Forming Apparatus)

Figure 7:
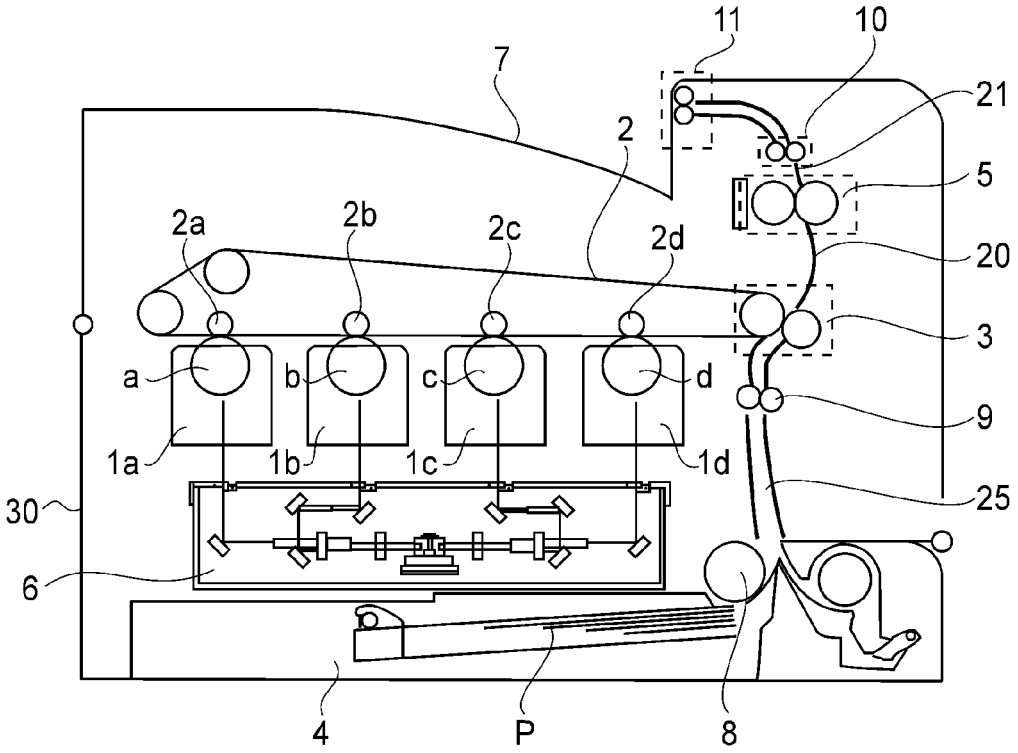
FIG. 7 is a schematic sectional view of the image forming apparatus which employs the fixing device in accordance with the present invention.

Referring to FIG. 7, the image forming apparatus, the fixing device of which is in accordance with the present invention is described about its overall structure. The image forming apparatus has four photosensitive drums a, b, c, and d, as image formation media, which are for forming yellow, magenta, cyan, and black monochromatic toner images, respectively. The four photosensitive drums a, b, c, and d are in the so-called tandem alignment, and are parallel to each other. The image forming apparatus has also an intermediary transfer belt 2, which is an intermediary means for transferring a monochromatic toner image from the photosensitive drums onto a recording medium. The intermediary transfer belt 2 is positioned so that it remains in contact with each of the four photosensitive drums a, b, c, and d.

The drums a, b, c, and d are driven by an unshown motor. More concretely, the drums a, b, c, and d are parts of process cartridges 1*a*, 1*b*, 1*c*, and 1*d*, one for one. Each process cartridge is provided with a primary charging device, a developing device, and a transfer charging device, which are unshown and are in the adjacencies of the peripheral surface of the corresponding drum. The image forming apparatus has also an exposing device 6, which is made up of a polygon mirror, etc., and is under the area in which the four drums are present.

After the peripheral surface of the drum a is uniformly charged, it is scanned by a beam of laser light projected by the exposing device 6, by way of the polygon mirror, while being modulated with electrical signals for forming a monochromatic yellow image, that is, one of the primary monochromatic images into which the image to be formed was separated. As a result, an electrostatic latent image is effected on the peripheral surface of the drum a. Then, the electrostatic latent image is developed into a visible image, that is, an image formed of yellow toner, with which the peripheral surface of the drum a is supplied by the developing device. Then, the yellow toner image is conveyed to the primary transfer station, which is the area of contact between the drum a and intermediary transfer belt 2, by the further rotation of the drum a. As the yellow toner image arrives at the primary transfer station, it is transferred (primary transfer) onto the intermediary transfer belt 2 by the primary transfer bias applied to the transfer charging member 2*a*.

Meanwhile a magenta toner image is formed on the drum b with the use of the same method as the method for forming the yellow toner image, with such a timing that the portion of the intermediary transfer belt 2, on which the yellow toner image is present, arrives at the image forming station for the formation of the magenta toner image, at the same time as the magenta toner image is transferred (primary transfer) onto the intermediary transfer belt 2. Thus, as the magenta toner image is transferred onto the intermediary transfer belt 2, it is layered onto the yellow toner image on the intermediary transfer belt 2. Then, as the intermediary transfer belt 2 is circularly moved further, a cyan toner image and a black toner image are layered on the combination of the yellow and magenta toner images on the intermediary transfer belt 2 in the primary transfer station of the corresponding image forming station.

Meanwhile, one of the sheets P of the recording medium in a cassette 4 is moved out of the cassette 4 by a pickup roller 8 while being separated from the rest, and is conveyed to a pair of registration roller 9 through a recording medium passage 25. Then, the sheet P is released by the registration rollers 9 with such a timing that it arrives at the second transfer station at the same time as the layered four monochromatic toner images, different in color, arrive at the second transfer station. Then, as the sheet P and the layered four monochromatic toner images, different in color, on the intermediary transfer belt 2 are conveyed together through the secondary transfer station, the four monochromatic toner images are transferred together (secondary transfer) onto the sheet P by the second transfer bias applied between a pair of secondary transfer rollers 3.

After the transfer of the four monochromatic toner images, different in color, onto the sheet P of recording medium, the sheet P is conveyed to the fixing device 5, being guided by a recording medium conveyance guide 20. In the fixing device 5, the four monochromatic toner images are fixed to the sheet P by the heat and pressure applied by the fixing device 5. That is, as the four monochromatic toner images, different in color, are subjected to the heat and pressure applied by the fixing device 5, they melt and mix, effecting thereby a full-color image, and become fixed to the sheet P as they cool down. Then, the combination of the sheet P and the fixed full-color image is discharged as a color print into a delivery tray 7 though a recording medium conveyance passage 21 by a pair of rollers 10 and a pair of rollers 11, which are on the downstream side of the fixing device 5 in terms of the recording-medium-conveyance direction.

Incidentally, the above-described image forming operation is started after the information such as recording-medium size, image-formation data, and the number of prints, which are set by a user, is transferred to the CPU 100 (FIG. 1) of the image forming apparatus. The abovementioned information is set by a user with the use of the control panel of the image forming apparatus, and/or a computer which is in connection to the image forming apparatus.

(Fixing Device)

Figure 1:
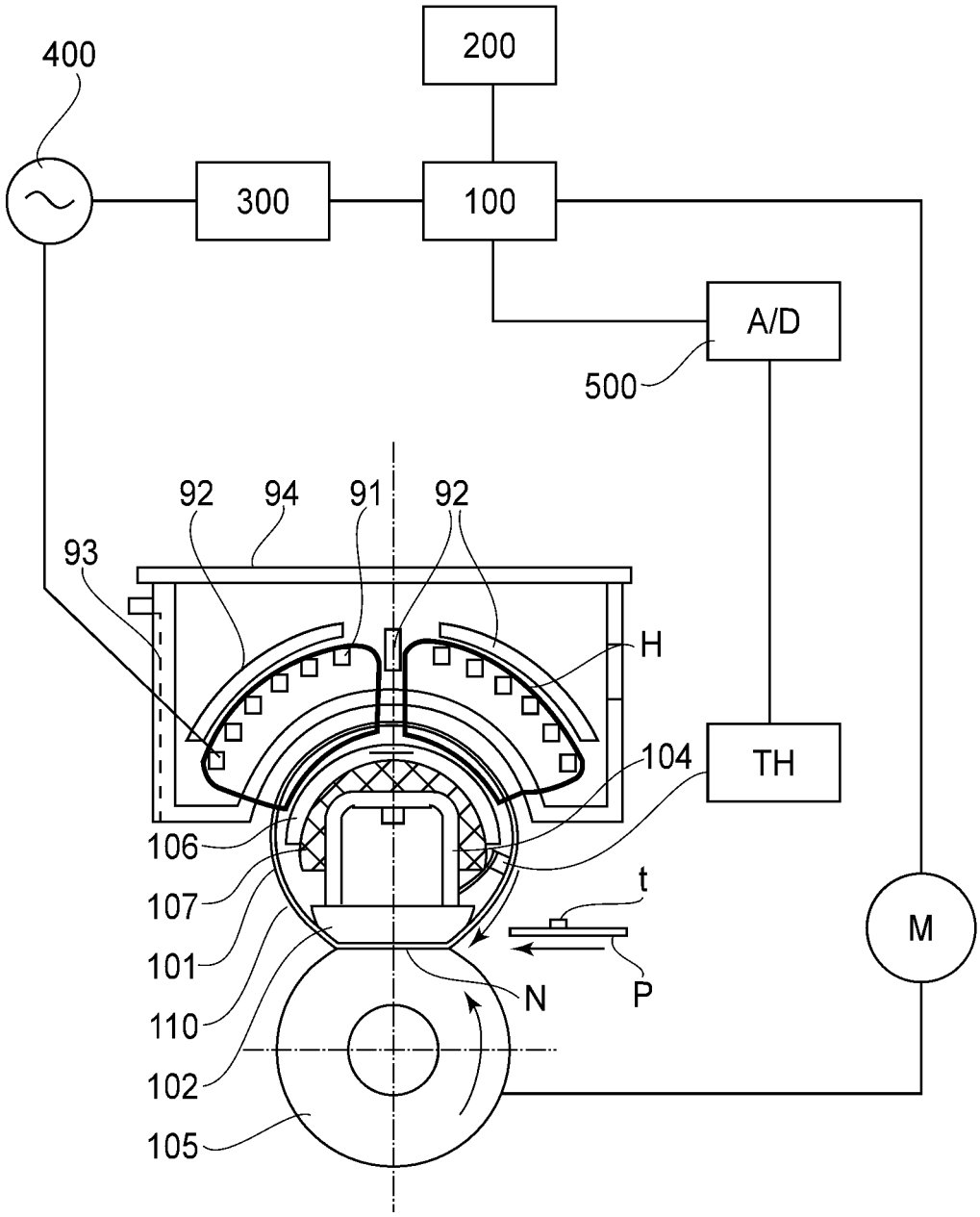
FIG. 1 is a sectional view of the image heating device as the fixing device of the image forming apparatus in the preferred embodiments of the present invention, at a plane parallel to the recording-medium-conveyance direction of the apparatus.
Figure 2:
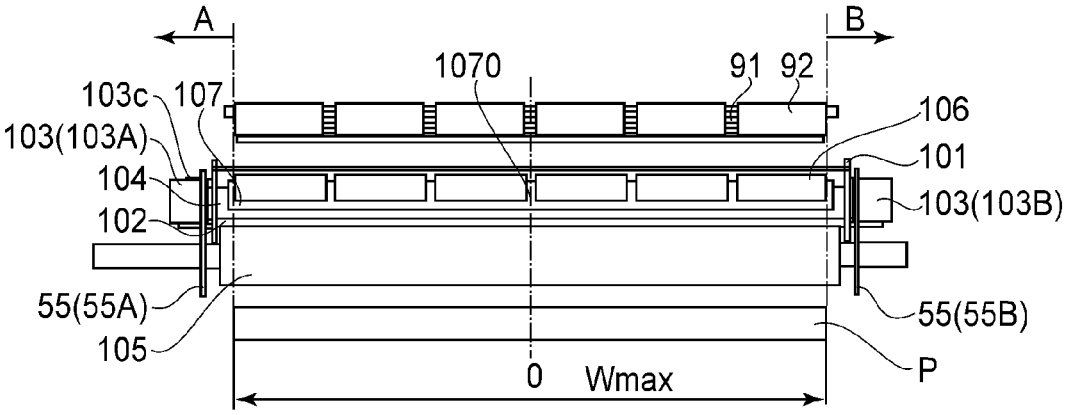
FIG. 2 is a sectional view of the fixing device in the first preferred embodiment of the present invention, at a plane perpendicular to the recording-medium-conveyance direction of the fixing device.
Figure 3:
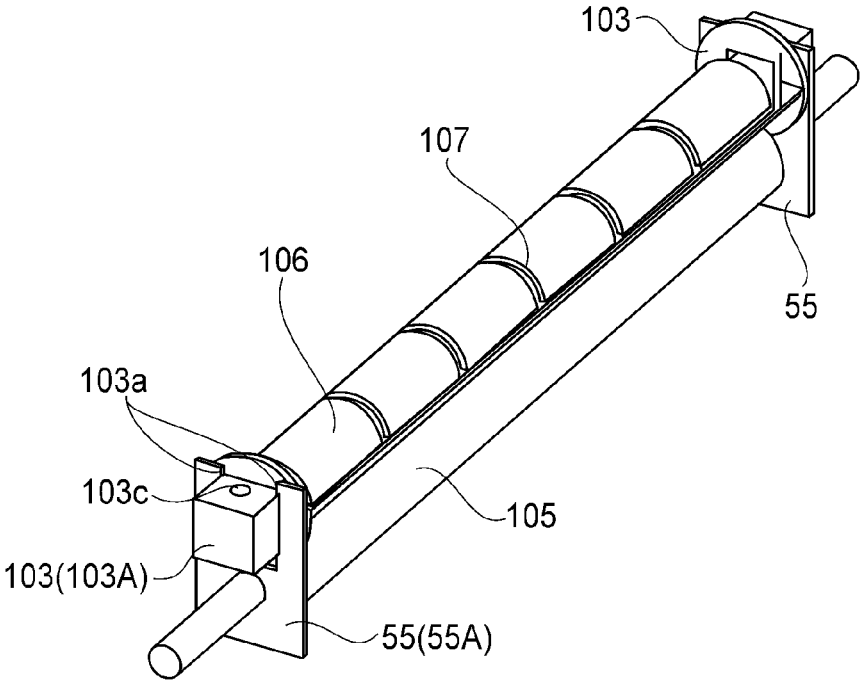
FIG. 3 is a perspective view of the fixing device in the first embodiment.

Next, the fixing device 5 as an image heating device in this embodiment is described with reference to FIGS. 1, 2, and 3. FIGS. 1 and 2 are a schematic sectional view of the fixing device 5 in this embodiment at a plane perpendicular to the recording-medium-conveyance direction, and a plane parallel to the recording-medium-conveyance direction, respectively. FIG. 3 is a perspective view of a combination of the belt unit and pressure roller in this embodiment.

1) Internal Structure of Fixation Belt Unit 110, and Pressure Application to Fixation Belt 101

Referring to FIG. 1, a component designated by reference numeral 101 is a fixation belt, in which heat can be generated by the magnetic flux from an excitation coil 91 (electromagnetic induction heat generation). The fixation belt 101 is an endless belt. It is circularly movable. Designated by reference numeral 105 is a pressure roller as a pressure applying member, which is in contact with the outward surface of the fixation belt 101. Incidentally, instead of the pressure roller 105 which is rotated in contact with the fixation belt 101, another endless belt which is suspended by multiple rollers and is circularly moved, or a stationary pad, may be employed as the pressure applying member.

A component designated by reference numeral 102 is a fixation belt backing member (which hereafter will be referred to simply as backup member) formed of heat resistant resin. The backup member 102 is kept pressed against the pressure roller 105 with the presence of the fixation belt 101 between itself and the pressure roller 105, being in contact with the inward surface of the fixation belt 101 and forming thereby a fixation nip N between the fixation belt 101 and pressure roller 105. Thus, the backup member 102 controls the pressure distribution in the fixation nip N.

Designated by a reference numeral 104 is a stay formed of a metallic substance (which in this embodiment is stainless steel). The stay 104 supports the backup member 102, and applies pressure upon the backup member 102. It is strong enough to withstand the reactive force from the pressure roller 105. Designated by reference numeral 106 is an inside magnetic core, which is on the inward side of the loop which the fixation belt 101 forms. The inside magnetic core 106 is for increasing in efficiency the magnetic circuit for induction heating, and also, functions as a magnetism shield. That is, not only does it increase the efficiency with which heat is generated in the fixation belt 101, but also, it covers the outward surface of the stay 104 (formed of metallic substance) to prevent the magnetic flux from reaching the stay 104, in order to prevent the stay 104 from being warmed (heated) by induction. In this embodiment, the stay 104 is not in contact with the inside core 106.

Designated by reference numeral 107 is a core supporting member formed of heat resistant resin. The core supporting member 107 supports the inside core 106. Designated by reference numeral 103 is a flange formed of heat resistant resin. The fixing device 5 has two flanges 103, which are at the lengthwise ends of the fixing device 5, one for one. Not only do the flanges 103 support the stay 104, but also, regulate the fixation belt 101 in shape, and also, in the position in terms of the direction perpendicular to the moving direction of the fixation belt 101.

The fixation belt unit 110 comprises the backup member 102, flanges 103, fixation belt 101, and stay 104. It is above the fixation roller 105, and opposes the pressure roller 105. It is under the pressure applied to the flanges 103 (which are at the lengthwise ends of unit 110) from unshown compression springs. Thus, the stay 104 (which extends in lengthwise direction) is kept pressed toward the pressure roller 105, with the presence of the fixation pad 102 and fixation belt 101 between itself and the pressure roller 105, forming thereby the fixation nip N having a preset width.

Referring to FIG. 1, designated by reference numeral 93 is a magnetic flux generating means, which comprises: an excitation coil 91; an outside magnetic core 92; and a holder 93 which holds the coil 91 and outside magnetic core 92. The magnetic flux generating means 93 is in the adjacencies of the surface layer of fixation belt 101. The outside core 92 is on the opposite side of the excitation coil 91 from the inside core 106.

2) Heating of Fixation Belt 101 by Electromagnetic Induction 2-a) Fixation Belt 101

The fixation belt 101, which is the member in which heat is generated by electromagnetic induction, is provide with an electrically conductive surface layer made of a highly magnetic metal (high in permeability) such as iron, so that the magnetic flux generated by the magnetic flux generating means can be confined in the metallic portion of the fixation belt 101 as much as possible. That is, the fixation belt 101 is made as high as possible in magnetic flux density. With the surface layer of the fixation belt 101 being higher in magnetic flux density, heat can be efficiently generated in the fixation belt 101 by the eddy current generated in its metallic surface layer.

2-b) Coil 91 and Outside Magnetic Core 92

Figure 9:
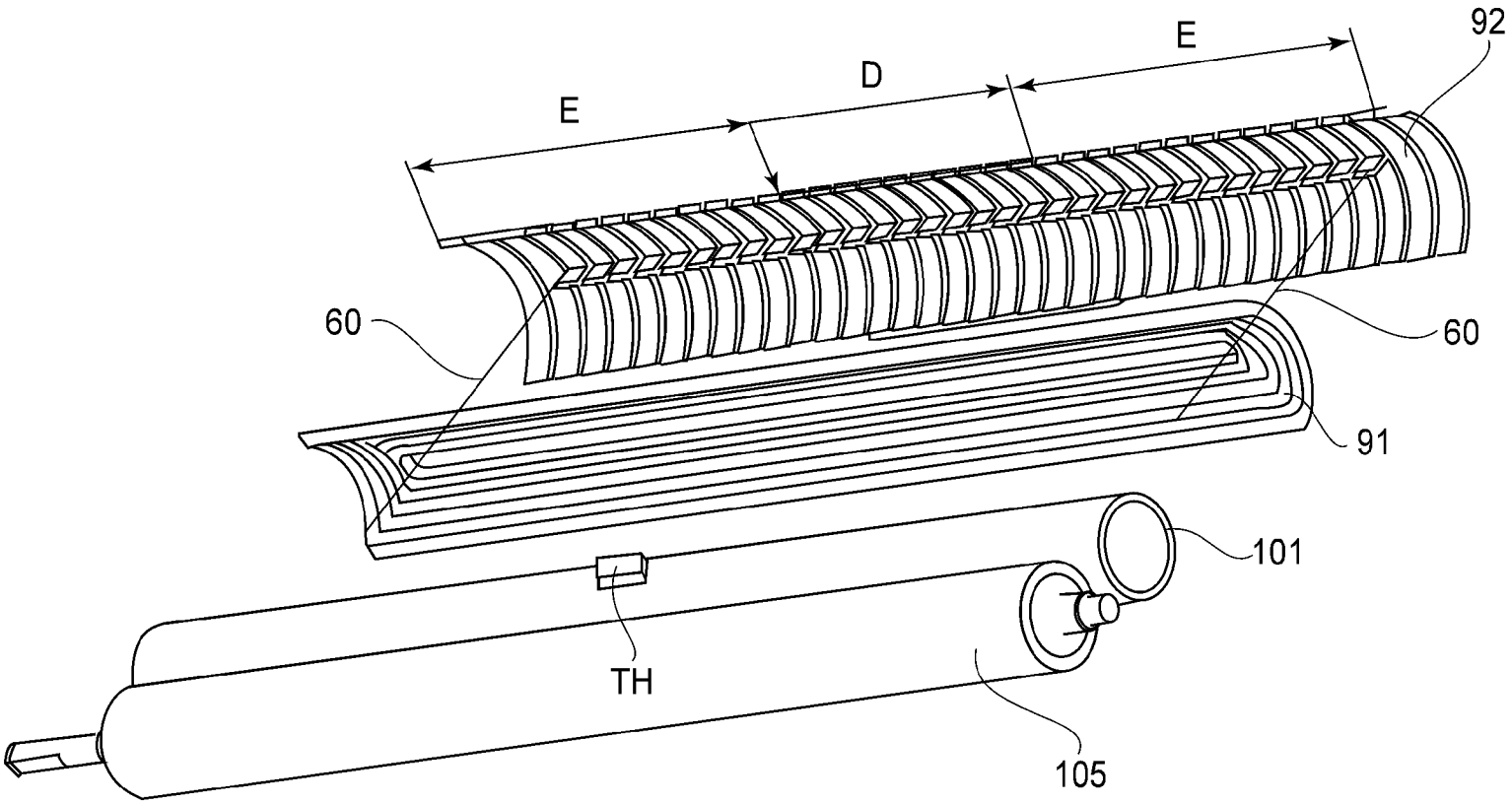
FIG. 9 is an exploded perspective view of the fixing device, inclusive of its excitation coil, in the first embodiment.

Referring to FIG. 9, the excitation coil 91 and outside magnetic core 92 are on the outward side of the fixation belt loop. Incidentally, FIG. 9 does not show the inside magnetic core 106, that is, the magnetic core which is on the inward side of the fixation belt loop. As AC current is supplied to the coil 91, the excitation circuit 300 generates alternating magnetic flux, which is guided by the cores 92 and core 106 to generate eddy current in the fixation belt 101, that is, a belt which can be heated by electromagnetic induction. The eddy current generates heat (Joule Effect) because of the electrical resistance (specific to fixation belt material) of fixation belt 101. That is, as the coil 91 is supplied with AC current, the fixation belt 101 is heated by electromagnetic induction.

The coil 91 is in the form of a long and narrow ellipse (like long and narrow boat), the lengthwise direction of which is parallel to the rotational axis of the fixation belt 101. It is wound in such a manner that its lengthwise end portions coincide in position with the edges of the fixation belt 101, one for one. It heats the fixation belt 101 by electromagnetic induction. More concretely, as seen from the top side of the fixing device 5, the coil 91 is roughly elliptic (like long and narrow boat), with its lengthwise direction being parallel to the lengthwise direction of the fixation roller 105 (perpendicular to widthwise direction of fixation belt 101). It is positioned so that its contour, in terms of cross section, matches the contour of the fixation belt 101. The wire, of which coil 91 is made, is litz wire composed of roughly 80-160 fine insulated strands which are 0.1-0.3 mm in diameter and woven together.

The coil 91 is wound 8-12 times in a manner to follow the contour of the inward surface of the outside magnetic core 92. It is in connection to the excitation circuit 300 so that it can be supplied with AC current.

The fixation belt unit 110 is structured so that the outside magnetic core 92 surrounds the peripheral portions of the coil 91 as well as the center portion of the coil 91. Thus, the outside magnetic core 92 plays the role of efficiently guiding the alternating magnetic flux generated by the coil 91, to the fixation belt 101 (member in which heat can be generated by electromagnetic induction). That is, it is used to contain the magnetic flux to increase the magnetic circuit in efficiency. As the material for the outside magnetic core 92, a substance such as ferrite, which is high in permeability and low in residual magnetic flux density, is used.

Referring to FIG. 9, the outside magnetic core 92 has multiple sections which make up a center group and a pair of end groups. The center group corresponds in position to the elliptical space which is at the center of the coil 91, whereas the end groups correspond in position to the lengthwise end portions of the coil 91. The sections in the end groups which correspond in position to the areas E in FIG. 9 are allowed to individually move in the direction to change their distance from the coil 91, whereas the sections in the center group which corresponds in position to the area D (FIG. 9) are solidly attached to the holder (FIG. 1). The center portion of the outside magnetic core 92 may be left in a single piece. The dimension of the area D in terms of the lengthwise direction of the fixing device is equal to the width of the narrowest sheet of recording medium usable with the fixing device.

2-c) Inside Magnetic Core 106

Referring to FIG. 1, as AC current is supplied to the coil 91 from the excitation circuit, the coil 91 generates alternating magnetic flux, which is guided by the outside magnetic core 92 and inside magnetic core 106 to the fixation belt 101 (in which heat can be generated by magnetic induction) to induce eddy current in the fixation belt 101. Although the inside core 106 is a single-piece core, it may be made up of multiple sections, which correspond in number and position to the multiple section of the center group of the outside magnetic core 92, one for one.

(Control of Image Fixing Operation)

Referring to FIG. 1, as the CPU 100 receives an image formation start signal from an external host apparatus 200, it warms up the fixing device 5 with a preset timing; it raises the temperature of the fixation belt 101 to a temperature level which is suitable for thermally melting a toner image. A soon as the surface temperature of the fixation belt 101 reaches a preset level, for example, 180° C., the image forming apparatus 30 (FIG. 7) is ready for image formation. The sequence for warming up the fixing device 5 is as follows: First, the CPU begins to drive the pressure roller 105 to cause the fixation belt 101 to be circularly moved by the rotation of the pressure roller 105. At virtually the same time as the fixation belt 101 begins to circularly move, or as soon as the fixation belt 101 begins to circularly move, the CPU begins to supply the coil 91 of the magnetic flux generating means 93 with AC current from the excitation circuit 300.

The CPU turns on the fixation motor M (means for rotating pressure roller 105) to drive the pressure roller 105. The driving force from the fixation motor M is transmitted to the pressure roller 105 through the mechanical power transmitting means (unshown), whereby the pressure roller 105 is rotated in the counterclockwise direction, shown in FIG. 1, at a preset speed. Thus, the rotation force from the pressure roller 105 is transmitted to the fixation belt 101 by the friction between the peripheral surface of the pressure roller 105 and the outward surface of the fixation belt 101, in the fixation nip N. Thus, fixation belt 101 is rotated by the rotational force from the pressure roller 105 in the clockwise direction, indicated by an arrow mark, at roughly the same speed as the peripheral velocity of the pressure roller 105, with its inward surface sliding on the bottom surface of the fixation pad 102, in the fixation nip N.

Further, the CPU 100 turns on the high frequency converter of the excitation circuit 300 (circuit for electromagnetically inducing eddy current to generate heat in fixation belt 101). Thus, the coil 91 of the magnetic field generating means 93 is supplied with the AC current (high frequency current) from an AC power source 400. Therefore, the magnetic flux, designated by reference letter H, is repeatedly generated and collapsed in the adjacencies of the coil 91. The magnetic flux H is guided by the outside magnetic core 92 to the fixation belt 101, and crosses the electrically conductive layer of the fixation belt 101. As the magnetic flux H crosses the electrically conductive layer of the fixation belt 101, eddy current is induced in the direction to generate such a magnetic field that counters the change in the magnetic field generated in the adjacencies of the coil 91. This eddy current generates heat in the electrically conductive layer of the fixation belt 101, by the amount which is proportional to the surface resistance of the electrically conductive layer, and also, the amount of the square of the eddy current. (Joule Effect). It is by this heat generation in the electrically conductive layer of the fixation belt 101 that the fixation belt 101 is increased in temperature while being circularly moved.

On the other hand, the thickness of the electrically conductive layer of the fixation belt 101 is less than the depth of penetration of the magnetic flux. Thus, the magnetic flux penetrates through the electrically conductive layer, and reaches the inside magnetic core 106, which is on the inward side of the fixation belt loop, forming thereby a closed magnetic flux circuit. Since the inside magnetic core 106 is positioned as close as possible while ensuring that a preset amount of distance is maintained between itself and fixation belt 101, the closed magnetic circuit is as tight as possible, increasing thereby the fixing belt 101 in the internal magnetic flux density. Therefore, the fixation belt 101 is uniformly increased in temperature in terms of its widthwise direction by the heat generated by the magnetic induction.

The temperature of the fixation belt 101 is detected by a thermistor TH, and the electrical information about the detected temperature of the fixation belt 101 is inputted into the CPU 100 through an A/D converter 500. The CPU 100 controls the excitation circuit 300, based on the information, that is, the detected temperature of the fixation belt 101, inputted from the thermistor TH, so that the temperature of the fixation belt 101 increases to a preset level (fixation temperature), and remains at the preset level. That is, the CPU 100 controls the amount by which the coil 91 is supplied with electric power by the AC power source 400.

As described above, the pressure roller 105 is driven, and the temperature of the fixation belt 101 is increased to the preset level and is kept at the preset level. While the pressure roller 105 is driven and the temperature of the fixation belt 101 is kept at the preset level, a sheet P of recording medium, on which an unfixed toner image t is present, is introduced into the fixation nip N, and then, is conveyed through the nip N, in such an attitude that the surface of the sheet P, on which the unfixed toner image t is present, faces the fixation belt 101 and is kept in contact with the outward surface of the fixation belt 101. While the sheet P is conveyed through the fixation nip N, the sheet P remains between the fixation belt 101 and pressure roller 105. Thus, the sheet P and the unfixed toner image thereon are given heat by the fixation belt 101, and also, are subjected to the pressure by the nip N. As a result, the unfixed toner image t on the sheet P is fixed to the surface of the sheet P, becoming thereby a permanent toner image. After being conveyed through the fixation nip N, the sheet P is separated from the outward surface of the fixation belt 101, and is conveyed out of the fixing device 5.

(Positioning of Fixing Device Components in Terms of Lengthwise Direction)

Referring to FIG. 2, the printer and its fixing device are structured so that when the sheet P is conveyed through the printer and fixing device, the center of the sheet P in terms of the direction perpendicular to the recording-medium-conveyance direction remains aligned with the centerline of the recording-medium conveyance passage (central alignment). Designated by a reference letter O is the central reference line (hypothetical line). Reference letters Wmax stand for the width of the path of the widest sheet of paper, which can be used with the image forming apparatus 30.

1) Positioning of Flange 101 Relative to Side Plate 55

Figure 4:
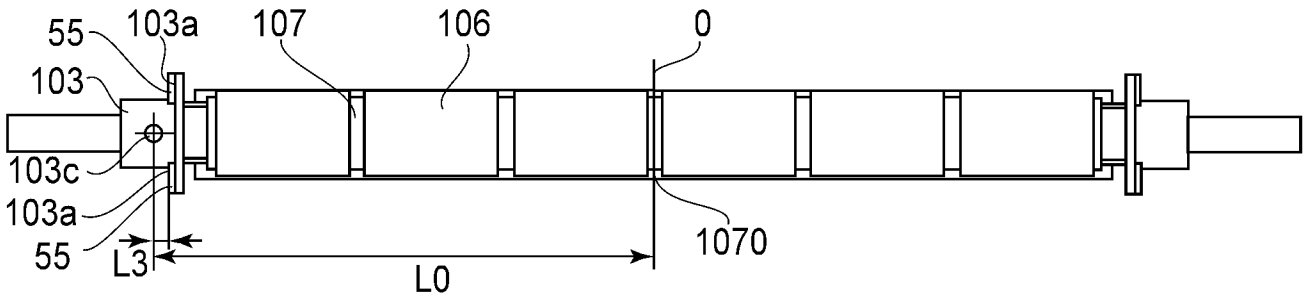
FIG. 4 is a drawing (top plan view of fixing device) for illustrating that the position of the stay of a fixing device in accordance with the present invention is under the control of one (left, for example) of the side plates of the fixing device.
Figure 5:
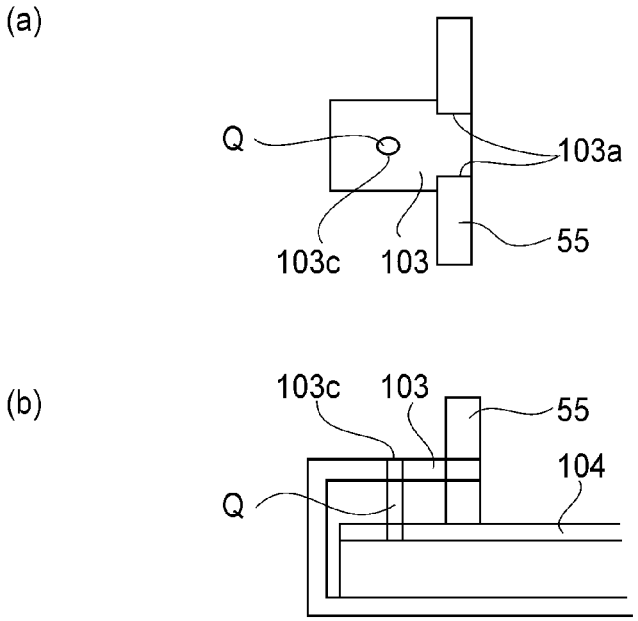
FIGS. 5(*a*) and 5(*b*) are drawings for illustrating in detail how the position of the stay of a fixing device is under the control of left side plate of the fixing device, FIG. 5(*a*) being a schematic top plan view of the lengthwise end portion of the combination of the left end portion of the flange 103 of the stay 104 of the fixing device, and the left side plate, in the first embodiment of 103 fixing device in the first preferred embodiment, and FIG. 5(*b*) being a schematic side plan view of the lengthwise end portion of the combination of the left end portion of the flange 103, left side plate, and stay 104.

The pressure roller 105 and fixation belt unit 110 of the fixing device 5 are supported by the pair of side plates 55 which are at the lengthwise ends of the fixing device 5. FIG. 4 is a top plan view of the fixation belt unit 110, and FIG. 5 is a schematic drawing of the left end portion of the fixation belt unit 110, shown in FIG. 4. Referring to FIG. 5, a portion 103*a* of the flange 103 is in engagement with the side plate 55.

2) Relationship between Flange 103 and Stay 104

The stay 104, which extends within the fixation belt unit 110 from one end of the fixation belt unit 110 to the other, is kept positioned by the stay positioning portion 103*c* of the flange 103, within a range A in FIG. 2. That is, referring to FIGS. 5(*a*) and 5(*b*), the stay 104 is locked to the flange 103 by a pin put through the hole of the flange 103 and the hole of the stay positioning portion 103*c*. Further, the fixation belt unit 110 is structured so that the portion 103B of the flange 103 is allowed to move relative to the stay 103 in the area B in FIG. 2, while remaining engaged with the stay 104.

The side plates 55 are provided with a vertical slit for allowing the flange 103 to slide on the side plates 55, toward, or away from, the pressure roller 105.

3) Positioning of Stay 104 and Side Plates 55

The stay 104 is positioned relative to one of the side plates 55 (which are at lengthwise ends of fixation belt unit 110, one for one) by the corresponding flange 103. More concretely, the portion 103A of the flange 103 is positioned relative to the side plate 55 (55A) by being engaged with the side plate 55 (55A), and the stay 104 and the portion 103A of the flange 103 are positioned relative to each other, by a pin Q inserted in the hole of the stay positioning portion 103*c* and the corresponding hole of the stay 104. That is, the stay positioning portion

103*c* functions as the first positioning portion, which is for keeping the stay 104 positioned relative to one (55A) of the side plates 55 of the fixing device 5, which are at the ends of the fixing device 5 in terms of the direction parallel to the rotational axis of the fixation belt 101.

On the area A side, the stay 104 is positioned relative to the side plate 55A by the portion 103A of the flange 103. On the area B side, the thermal expansion of the two side plates 55 and the thermal expansion of the stay 104 can be accommodated by the above described relationship between the stay 104 and the portion 103B of the flange 103. In other words, the stay 104 is positioned by the flange 103 so that it remains locked with the side plate 55A, that is, the side plate in the area A.

In this embodiment, it is by the portion 103A (in area A) of the flange 103 that the stay 104 is immovably positioned relative to the side plate 55A. However, the stay 104 may be directly positioned by (attached to) the side plate 55A.

4) Positioning of Core Supporting Member 107 and Stay 104

Figure 6:
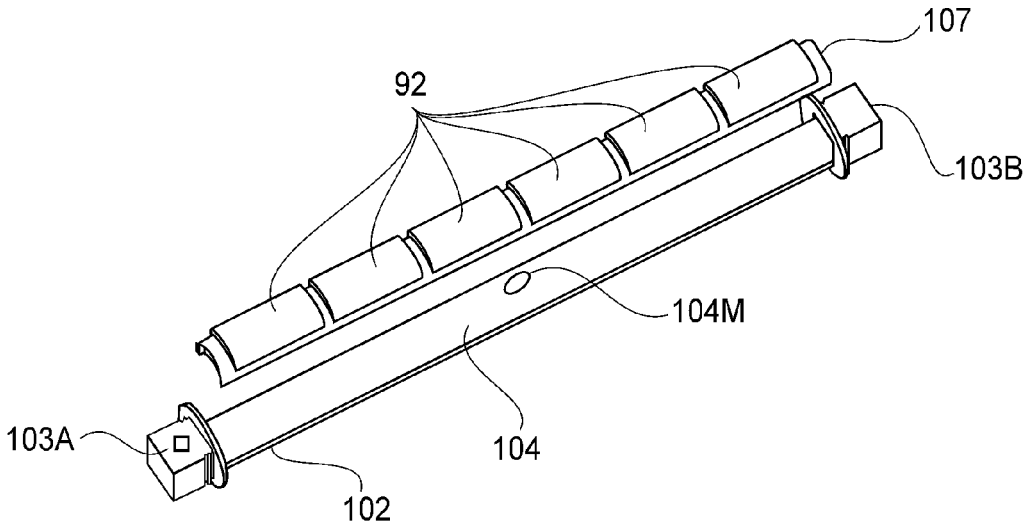
FIG. 6 is an exploded perspective view of the fixing device in the first embodiment, and is for illustrating how the core supporting member is held to the stay to keep the lengthwise center of the core supporting member aligned with the lengthwise center of the stay.

In terms of the lengthwise direction of the fixation belt unit 110, the position of the core supporting member 107 formed of a resinous substance is controlled by the stay 104 formed of a metallic substance, in the adjacencies of the center line O of the recording-medium conveyance passage. That is, referring to FIG. 6, the stay 104 has a core supporting member positioning portion 104 M (hole 104M), which is at its center in terms of its lengthwise direction. Thus, the core supporting member 107 is attached to stay 104 so that the projection of the core supporting member 107, which is at the lengthwise center of the core supporting member 107, fits in to the hole 104M of the stay 104. Therefore, the core supporting member positioning portion 104M (hole 104M) functions as the second positioning portion, which is the positioning portion for positioning the core supporting member 107 relative to the stay 104 so that the lengthwise left and right portions of the core supporting member 107 relative to its lengthwise center remains symmetrical relative to the lengthwise center of the stay 104, and the lengthwise left and right portions of the stay 104 relative to its lengthwise center remains symmetrical relative to the lengthwise center of the core supporting member 107.

5) Effect of Temperature Increase (Upon Stay 104 and Portion 103B of Flange 103)

In this embodiment, the portion 103B of flange 103 (right end portion of flange 103 in FIG. 6) is allowed to move relative to the stay 104 (slid on stay 104), as described previously. The distance by which the portion 103B is allowed to move relative to (slide on) the stay 104 is set in consideration of the amount of the thermal expansion of the stay 104, for the following reason:

Generally speaking, the amount of the lengthwise expansion of the stay 104 can be obtained with the use of the following mathematical equation.

$$\Delta L=\alpha\times L\times(T-T0) \quad (1)$$

ΔL: amount of thermal expansion

α: coefficient of linear thermal expansion

L: length

T: temperature

T0: room temperature.

The stay 104 is formed of stainless steel. Thus, α=1.6×20−5(/K).

Thus, if L (length of portion of stay 104 between side plates 55)=400 mm; T=200° C.; and T0=20° C., and also, the position of the stay 104 and the position of the core supporting member 107, in terms of the lengthwise direction of the fixing device, is under the control of the side plate 55 (55A) in the area A (stay 4 and core supporting member 107 are directly or indirectly attached to side plate 55A so that they are not movable relative to side plate 55A in terms of lengthwise direction), the amount of the lengthwise (linear) thermal expansion of the stay 104 is 1.15 mm. Thus, in this embodiment, the distance by which the stay 104 is allowed to move relative to the core supporting member 107 is set to 1.5 mm.

6) Effect of Thermal Expansion (Upon Stay 104 and Core Supporting Member 107)

Next, the thermal expansion of the stay 104 and core supporting member 107 in terms of the lengthwise direction of the fixation belt unit 110 is described. The stay 104 is formed of stainless steel, and therefore, α=1.6×10−5(/K), whereas the core supporting member 107 is formed of heat resistant resin (PPS), and therefore, α=6.0×10−5(/K). Thus, if L (length of portion of stay 104 between side plates 55)=400 mm; T=200° C.; and T0=20° C., and also both the stay 104 and core supporting member 107 are attached to one of the side plates 55 (55A in this embodiment). Then, the amount of the lengthwise (linear) thermal expansion of the stay 104 and the amount of the lengthwise (linear) thermal expansion of the core supporting member 107, which are obtainable with the use of Equation (1) are 1.15 mm and 4.32 mm, respectively.

In this embodiment, the stay 104 is made of a metallic substance, and is attached to one (55A) of the side plates 55, being thereby positioned by the side plate 55A. Thus, the amount by which the core supporting member 107 in this embodiment, which is formed of heat resistant resin, thermally expands in the lengthwise direction of the fixation belt unit 110 is far smaller than a core supporting member (107) of any fixation belt unit (110) in accordance with the prior art, which is directly attached to one of the side plates (55). Further, the core supporting member 107, which is greater in the amount of the lengthwise thermal expansion than the stay 104, is attached to the stay 104 by fitting its projection (107O), which is at the lengthwise center of the core supporting member 107, in the center hole 104M of the stay 104, as described above, being thereby aligned with the center line O of the recording-medium conveyance passage. Thus, the thermal expansion of the core supporting member 107 in its lengthwise direction is symmetrical relative to the centerline O of the recording-medium conveyance passage.

Figure 8:
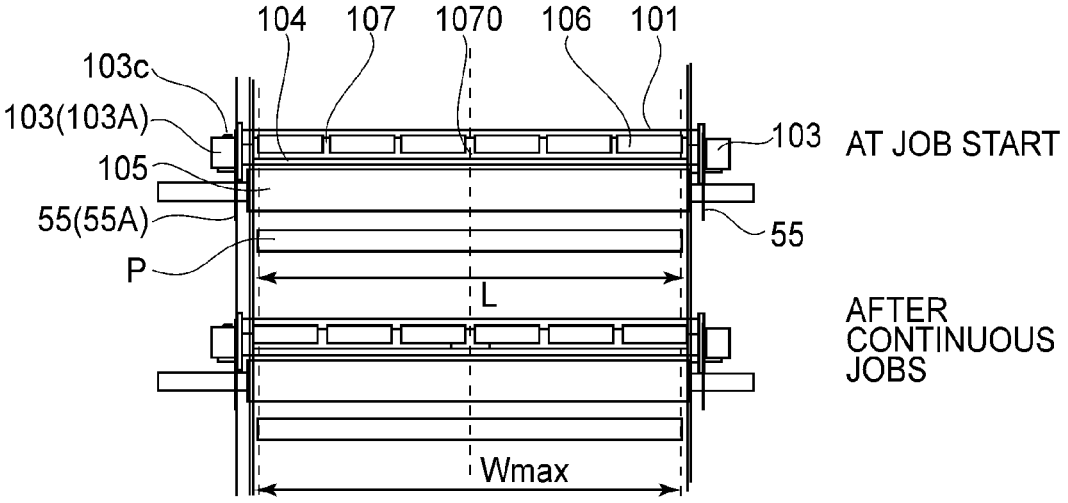
FIG. 8 is a combination of the schematic side view of the fixing device in the first preferred embodiment of the present invention, at the beginning of a job, and the schematic side view of the fixing device in the first embodiment, after the substantial increase in the temperature of the core, and shows the position of the core at the beginning of the job and the position of the core after the significant increase in the temperature of the core.

Therefore, even after the conveyance of a substantial number of sheets of the recording medium through the fixing device, the core supporting member 107 is far less asymmetrical with reference to the centerline O of the recording-medium conveyance passage, as shown in FIG. 8, than the core supporting member (107) of any fixing device in accordance with the prior art, which is directly attached to one of the side plates of the fixing device. Therefore, the inside core 106, which has significant effects upon the temperature distribution of the fixation belt 101, and is supported by the core supporting member 107, remains far less asymmetrical than the core (106) of any fixation belt unit 110 in accordance with the prior art. In other words, the present invention can make it possible to significantly reduce the gap between the inside core 106 and coil 91 at both ends of the fixation belt unit 110 in terms of the direction perpendicular to the recording-medium-conveyance direction. Therefore, the present invention can provide a fixing device which does not suffer from the problem that even when a sheet of a recording medium, which is narrower than the widest sheet of recording medium usable with an image forming apparatus (fixing device) is used as the recording medium, the portion of the fixing member, which corresponds in position to one of the areas of the recording-medium conveyance passage, which is outside the path of the narrow sheet of recording medium, is thermally damaged by its excessive temperature increase, or the problem that "cold offset" occurs because of the excessive temperature drop which occurs to the portion of the fixing member, which corresponds in position to one of the areas of the recording-medium conveyance passage, which is inside the path of the narrow sheet of recording medium.

Referring again to FIG. 1, the core supporting member 107 is in the adjacencies of the fixation belt 101 (in which heat can be generated by electromagnetic induction), and also, is in contact with the inside core 106 which is virtually in contact with the fixation belt. On the other hand, there are the inside core 106 and core supporting member 107 between the stay 104 and fixation belt 101. In other words, its distance from the fixation belt 101 is relatively long. Therefore, the heat from the fixation belt 101 is more likely to transfer to the core supporting member 107, being therefore more likely to be increased in temperature by the heat from the fixation belt 101 than the stay 104. Thus, the stay 104 remains lower in temperature T than the core supporting member 107, being therefore smaller in the extent to which it is affected by its thermal expansion.

Next, the effect of the thermal expansion of the left end portion 103A of the flange 103 upon the asymmetry of the fixation belt unit 110, with reference to the centerline O of the recording-medium conveyance passage, is described. Assuming that the distance L3 between the side plate engaging portion 103*a* of the left end portion 103A of the flange 103 and the flange positioning portion 103*c* is 3 mm; the temperature of the portion 103A after the conveyance of a substantial number of sheets of recording medium through the fixing device is 80° C., the amount ΔS of the thermal expansion of the portion of the flange 103, which is between the positioning portion 103*a* of the flange 103A and the side plate 55A, is 0.01 mm (ΔS=0.01 mm). On the other hand, the amount ΔS of the thermal expansion of the stay 104, between the flange positioning portion 103*a* of the flange 103 and the center O of the recording-medium conveyance passage is 0.5 mm (ΔS=0.5 mm) because L0=200 mm and T=180° C. In other words, it is roughly 2% of the overall asymmetry. Therefore, the effect of the lengthwise thermal expansion of the left end portion 103A of the flange 103 is ignorable.

Embodiment 2

Figure 10:
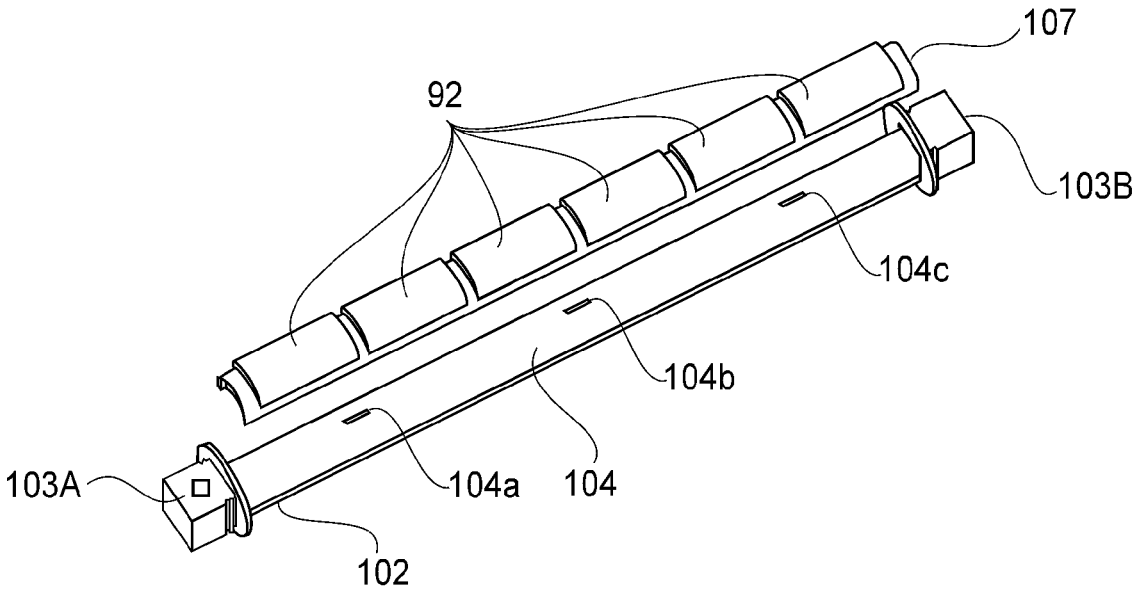
FIG. 10 is an exploded perspective view of the fixing device in the second preferred embodiment of the present invention, and is for illustrating how the core supporting member is held to the stay to keep the lengthwise center of the core supporting member aligned with the lengthwise center of the stay.
Figure 11:
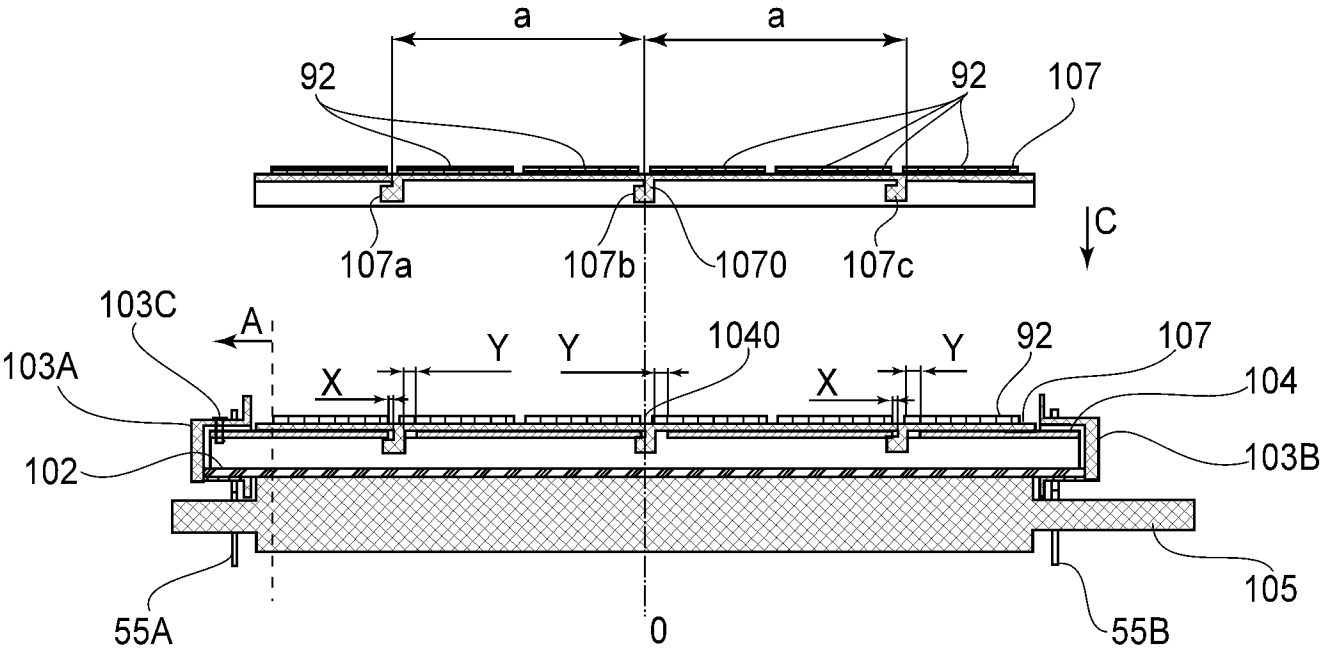
FIG. 11 is a schematic sectional view of the fixing device in the second preferred embodiment of the present invention, at a plane parallel to the lengthwise direction of the fixing device, and is for illustrating how the core supporting member is held to the stay to keep the lengthwise center of the core supporting member aligned with the lengthwise center of the stay.

The image forming apparatus in this embodiment and its fixing device are the same in structure in terms of the lengthwise direction of the fixing device, and also, in fixing operation, as the counterpart in the first embodiment. Therefore, they are not going to be described here. This embodiment is different from the first embodiment in that the core supporting member 107 and stay 104 are provided with projections and grooves, respectively, and the core supporting member 107 is attached to the stay 104 by sliding its projections into the grooves of the stay 104, one for one, so that the core supporting member 107 is allowed to move (slide) relative to the stay 104. FIG. 10 is an exploded perspective view of the fixation belt unit 110 (minus fixation belt 101). FIG. 11 is a schematic exploded sectional view of the fixation belt unit 110 (minus the fixation belt 101), at a vertical plane which is parallel to the lengthwise direction of the fixation belt unit 110 and coincides with the axial line of the pressure roller 105.

Hereafter, the structural arrangement by which the core supporting member 107 is kept attached to the stay 104 is described. The core supporting member 107, which supports the inside magnetic core 106, has three anchoring projections 107*a*, 107*b*, and 107*c*, shown in FIG. 11, whereas the stay 104 has three anchoring grooves 104*a*, 104*b*, and 104*c*, shown in FIG. 10. The core supporting member 107 is attached to the stay 104 by fitting the anchoring projections 107*a*, 107*b*, and 107*b* of the core supporting member 107 into the anchoring grooves 104*a*, 104*b*, and 104*c*, of the stay 104, respectively, in the direction indicated by an arrow mark C in FIG. 11, and then, sliding them in the direction indicated by an arrow mark A. Consequently, the positioning portion 107O of the core supporting member 107 and the positioning portion 104O of the stay 104 align with each other, and also, with the centerline O of the recording-medium conveyance passage, being thereby correctly positioned in terms of the lengthwise direction of the fixation belt unit 110.

Further, in consideration of the thermal expansion of the stay 104, the core supporting member 107, etc., in the lengthwise direction of the fixation belt unit 110, the grooves 104*a*, 104*b*, and 104*c* are provided with margins X and Y. The margin X is provided in consideration of the thermal expansion of the core supporting member 107 in the direction A, to prevent the problem that as the fixation belt 101 is heated, the anchor portions of the core supporting member 107 are made to expand in the direction A by the heat from the fixation belt 101 and causes its anchor portions to interfere with the stay 104.

As for the margin Y, it is provided in consideration of the thermal expansion of the core supporting member 107 in the opposite direction from the direction A, to prevent the problem that as the fixation belt 101 is heated, the core supporting member 107 is made to expand in the opposite direction from the direction A by the heat from the fixation belt 101 and causes its anchor portions to interfere with the stay 104, and also, in consideration of the thermal expansion of the core supporting member 107 in the direction A, and the amount by which the stay 104 and core supporting member 107 are made to slide relative to each other, by their thermal expansion.

In this embodiment, the stay 104 is made of stainless steel. Therefore, $\alpha=1.6\times10-5(/K)$. The core supporting member 107 is made of heat resistant resin (PPS). Therefore, $\alpha=6.0\times10-5(/K)$. It is the opposite end of the anchor projection 107*a* from the positioning portion 107O and the opposite end of the anchor projection 107*c* from the positioning portion 107O, that are likely to interfere with the stay 104 in terms of the direction A. It is assumed here that the distance between the opposite end of the anchoring projection 107*a* from the positioning portion 107O, and the positioning portion 107O is a, and so is the distance between the opposite end of the anchoring projection 107*c* from the positioning portion 107O, and the positioning portion 107O.

If it is assumed here that a=155 mm; T=200° C.; and TO=20° C., and also, that the core supporting member 107 is attached to the stay 104 so that both the center of the stay 104 and the center of the core supporting member 107 are aligned with each other, as well as the centerline O of the recording-medium conveyance passage. Then, the amount ΔL by which the stay 104 and core supporting member 107 are moved in the direction A by their thermal expansion, in the adjacencies of the opposite end of the projection portion 107*a* from the centerline O of the recording-medium conveyance passage, and also, in the adjacencies of the opposite end of the projection 107*c* from the center line O of the recording conveyance passage, become as shown in Table 1, based on Mathematical Equation (1).

TABLE 1

| | Material | Coefficient of linear thermal expansion a (1/K) | Thermal expansion amount (b = 155 mm) |
|---|---|---|---|
| Stay 104 | Steel | 1.1 × 10^−5 | 0.307 mm |
| Core support 107 | PPS | 6.0 × 10^−5 | 1.67 mm |

In order to prevent the problem that as the fixation belt 101 is heated, the anchor projection 107*a* and 107*c* of the core supporting member 107 is made to interfere with the stay 104 by the thermal expansion of the core supporting member 107 in the direction A, the space (margin) between the opposite end of the projection 107*a* from the centerline O of the recording-medium conveyance passage and the corresponding groove of the stay 104, and the space between the opposite end of the portion 107*c* from the centerline of the recording-medium conveyance passage and the corresponding groove of the stay 104, have to be no less than 1.36 mm (=1.67 mm-0.307 mm) in terms of the lengthwise direction of the fixation belt unit 110. In this embodiment, therefore, the margin X for the prevention of the interference between the stay 104 and core supporting member 107 was set to 2 mm, whereas the margin Y was set to 8 mm in consideration of a distance of 6 mm by which the stay 104 and core supporting member 107 have to be allowed to move (slid) relative to each other in order for the core supporting member 107 to be anchored to the stay 104, and also, in consideration of the difference between the amount (6 mm) by which the core supporting member 107 has to be moved relative to the stay 104 in order for the core supporting member 107 to be anchored to the stay 104, and the margin X.

With the employment of the above described structural arrangement, the core supporting member 107, which is larger in the amount of thermal expansion in the lengthwise direction than the stay 104, is anchored to the stay 104 so that its center portion 107O, that is, its positioning portion, aligns with the positioning portion 104O of the stay 104 and the centerline O of the recording-medium conveyance passage. Therefore, the thermal expansion of the core supporting member 107 in its lengthwise direction is symmetrical with reference to the centerline O of the recording-medium conveyance passage. In other words, the inside magnetic core 106, which is supported by the core supporting member 107 and is responsible for the temperature distribution of the fixation belt 101, becomes far less asymmetrical relative to the centerline O of the recording-medium conveyance passage than the inward core (106) of any fixation belt unit (110) in accordance with the prior art. In other words, the present invention can provide a fixing device which does not suffer from the problem that when a sheet of the recording medium, which is narrower than the recording-medium passage, is used as the recording medium for a given image forming operation, the portion of the fixing member, which corresponds in position to one of the areas of the recording-medium conveyance passage that are outside the path of the narrower sheet of the recording medium, becomes thermally damaged because of the excessive temperature increase, or the problem that the portion of the fixing member, which corresponds in position to one of the areas of the recording-medium conveyance passage that are within the path of the narrower sheet of recording medium excessively reduces in temperature, causing thereby the "cold offset".

Embodiment 3

Figure 12:
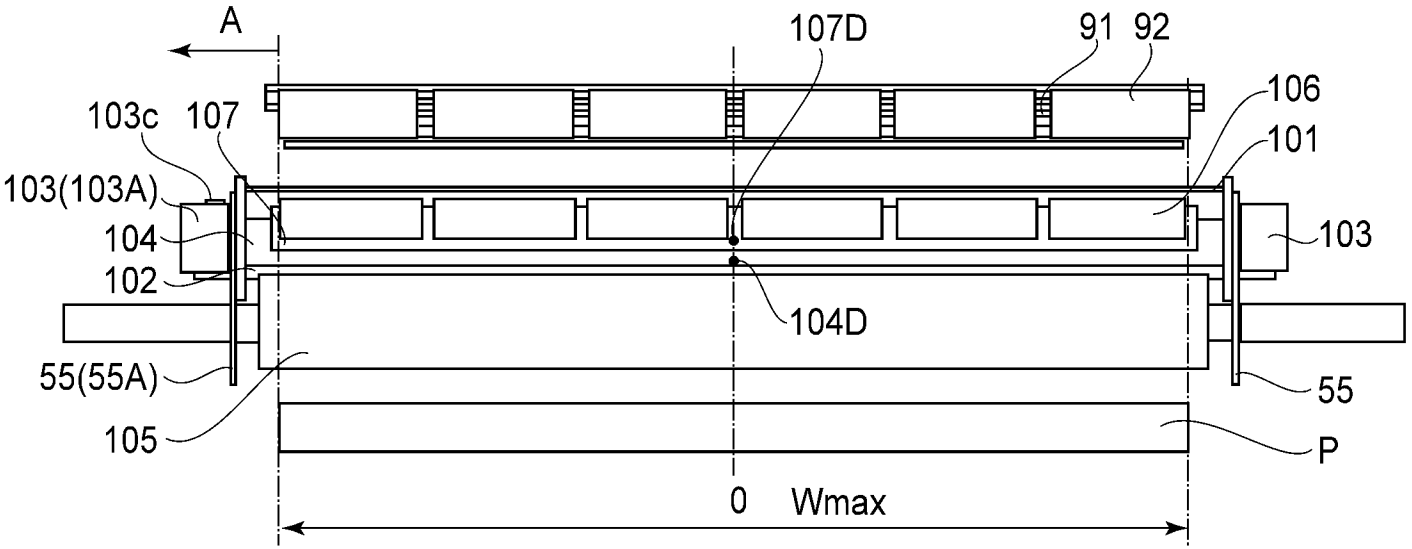
FIG. 12 is a schematic sectional view of the fixing device in the third preferred embodiment of the present invention, at a plane parallel to the lengthwise direction of the fixing device.

The image forming apparatus in this embodiment, and its fixing device, are the same in structure in terms of the lengthwise direction of the fixing device, and also, in fixing operation, as the counterpart in the first embodiment. Therefore, they are not going to be described here. This embodiment is different from the first embodiment in that the backup member 102 is attached to the stay 104 so that the lengthwise center of the backup member 102 is aligned with the lengthwise center of the stay 104. FIG. 12 is a schematic sectional view of the fixing device in this embodiment, at a vertical plane which is parallel to the lengthwise direction of the fixing device. In this embodiment, the stay 104 is solidly attached to the one of the side plates 55 (right plate 55A in FIG. 12) with the presence of the flange 103 between itself and the side plate 55A, and the core supporting member 107 is attached to the stay 104 so that its lengthwise center and the lengthwise center of the stay 104 are in the proximity of the centerline O of the recording-medium conveyance passage. Therefore, the fixing device in this embodiment is far less asymmetrical in temperature distribution, with reference to the center line O of the recording-medium conveyance passage, in terms of its lengthwise direction than any fixing device in accordance with the prior art, even after a substantial number of sheets of recording medium are continuously conveyed through the fixing device.

Further, in this embodiment, the backup member 102, which is in the form of a fixation pad formed of heat resistant resin, is attached to the stay 104 so that the lengthwise center (102D) of the backup member 102 aligns with the lengthwise center (104D) of the stay 104, and also, with the centerline O of the recording-medium passage. The backup member 102 is responsible for the pressure distribution of the fixation nip N in terms of the lengthwise direction of the fixing device 5.

As a substantial number of sheets of a recording medium are continuously conveyed through the fixing device, the backup member 102 is made to expand by the heat from the fixation belt 101 in the lengthwise direction of the fixing device 5. Therefore, if the backup member 102 is solidly attached to the side plate 55A, the pressure distribution of the fixation nip N becomes asymmetrical with reference to the centerline O of the recording-medium passage, as a large number of sheets of recording medium are continuously conveyed through the fixing device 5. Further, the relationship between the temperature distribution and pressure distribution of the fixation nip N also becomes asymmetrical with reference to the centerline O of the recording-sheet conveyance passage. Consequently, the sheet P of recording medium becomes askew while it is conveyed through the fixation nip N. If the sheet P becomes askew in the fixation nip N, it sometimes occurs that the sheet P becomes misaligned with a toner image as the toner image is transferred (secondary transfer) onto the sheet P in the secondary transfer station between the pair of transfer rollers 3, and/or the sheet P wrinkles in the fixation nip N.

In this embodiment, however, the backup member 102 is attached to the stay 104 so that the lengthwise center of the backup member 102 aligns with the lengthwise center of the stay 104, and also, it roughly aligns with the centerline O of the recording-medium conveyance passage, before the fixation belt 101 is heated. Therefore, the fixing device in this embodiment is far less asymmetrical with reference to the recording medium passage centerline O in terms of the relationship between the temperature distribution and pressure distribution of the fixation nip N than a fixing device in accordance with the prior art. Therefore, the fixing device in this embodiment does not cause the misalignment between a sheet P of recording medium and a toner image, in the second transfer station, and the wrinkling of the sheet P in the fixation nip N.

Embodiment 4

The image forming apparatus in this embodiment, and its fixing device, are the same in structural arrangement in terms of the lengthwise direction of the fixing device, and also, the fixing operation in this embodiment is the same as the one in the first embodiment. Therefore, they are not going to be described here. This embodiment is different from the first embodiment in that the excitation coil 91 and outside magnetic core 92 are attached to the stay 104 in such a manner that in terms of the lengthwise direction of the fixing device 5, the center of the excitation coil 91 and the center of the outside magnetic core 92 align with the center of the stay 104. The pressure roller 105 and fixation belt unit 110 in this embodiment also are supported by the side plates 55 which are at the lengthwise ends of the fixing device, one for one, like the counterparts in the first embodiment.

More concretely, the side plate engaging portion 103*a* of the flange 103 of the fixation belt unit 110 is in engagement with of the side plate 55 (55A). The stay 104 is positioned (attached to) by the side plate 55A, with the presence of the portion 103*c* of the flange 103 between the stay 104 and the side plate 55A, whereas the core supporting member 107 is positioned (attached to) the stay 104 so that its center remains aligned with the lengthwise center of the stay 104, and remains in the adjacencies of the sheet passage centerline O (107O). Therefore, the temperature distribution in the fixation nip N of the fixing device in this embodiment is significantly less asymmetrical in terms of the lengthwise direction of the fixing device, with reference to the sheet passage center O, even after a substantial number of sheets P of the recording medium are conveyed through the fixation nip N, than that of any fixing device in accordance with the prior art.

Figure 13:
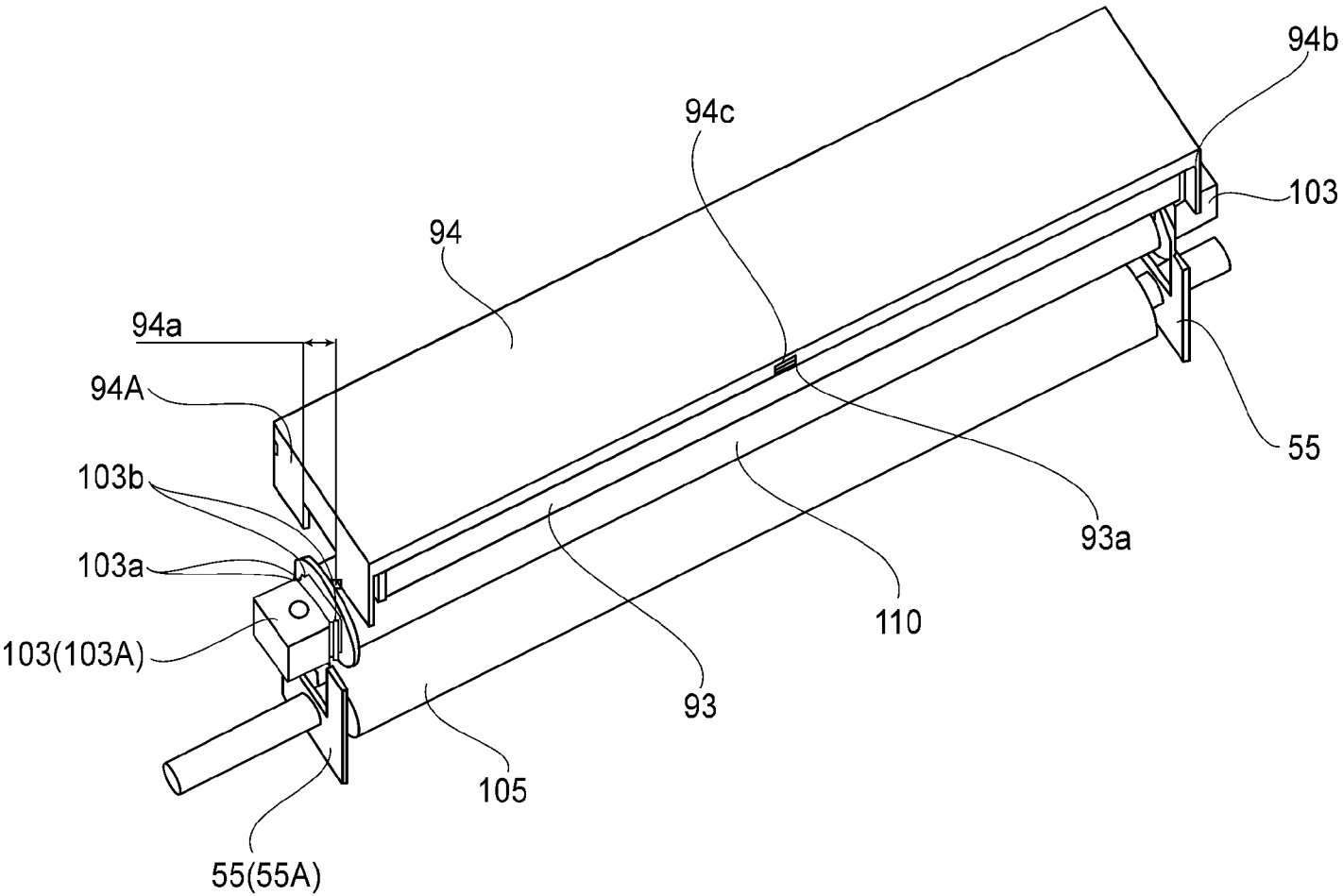
FIG. 13 is a perspective view of the fixing device in the fourth preferred embodiment of the present invention.
Figure 14:
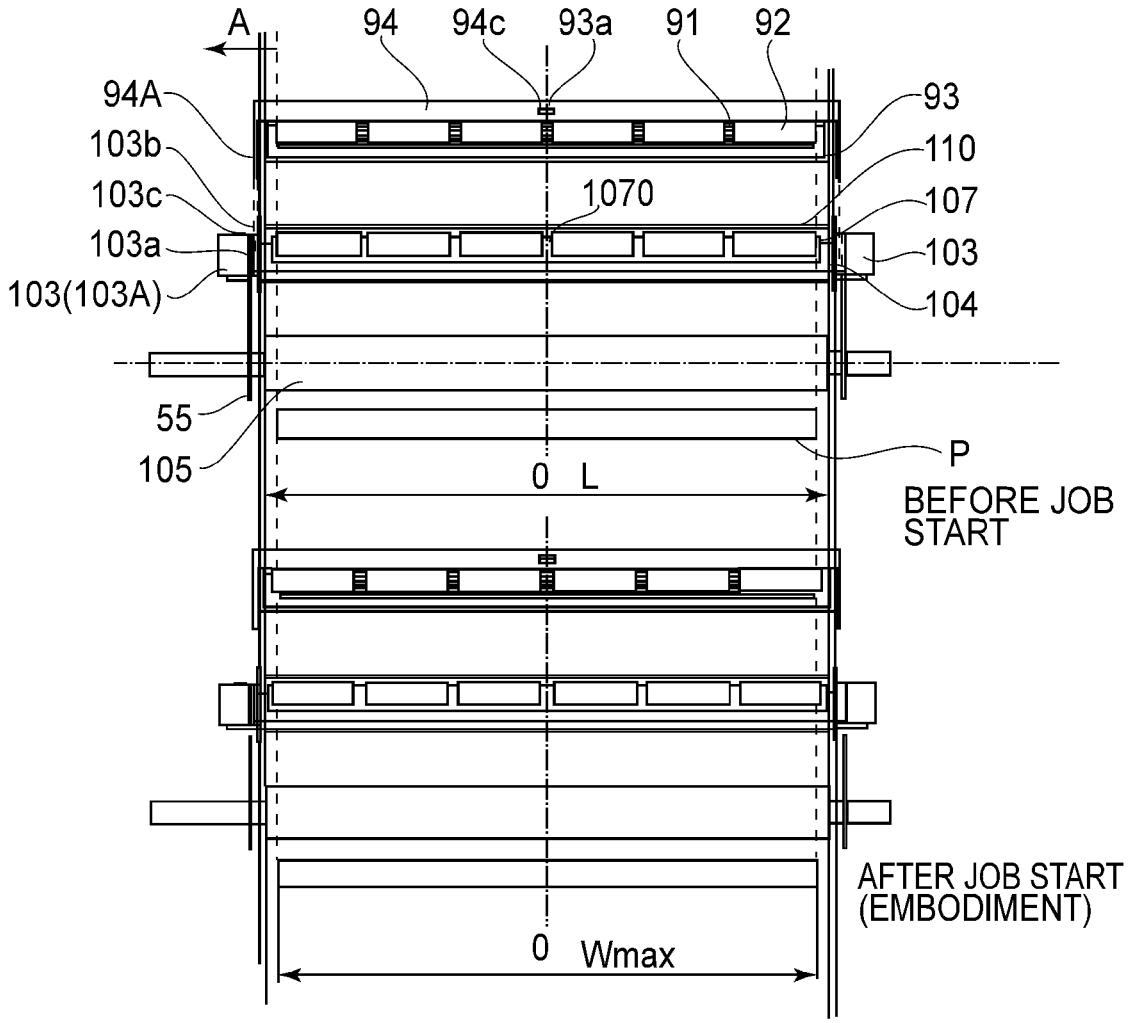
FIG. 14 is a combination of a schematic side view of the fixing device in the fourth embodiment, at the beginning of a job, and a schematic side view of the fixing device in the fourth embodiment, after the substantial increase in the temperature of the core.
Figure 15:
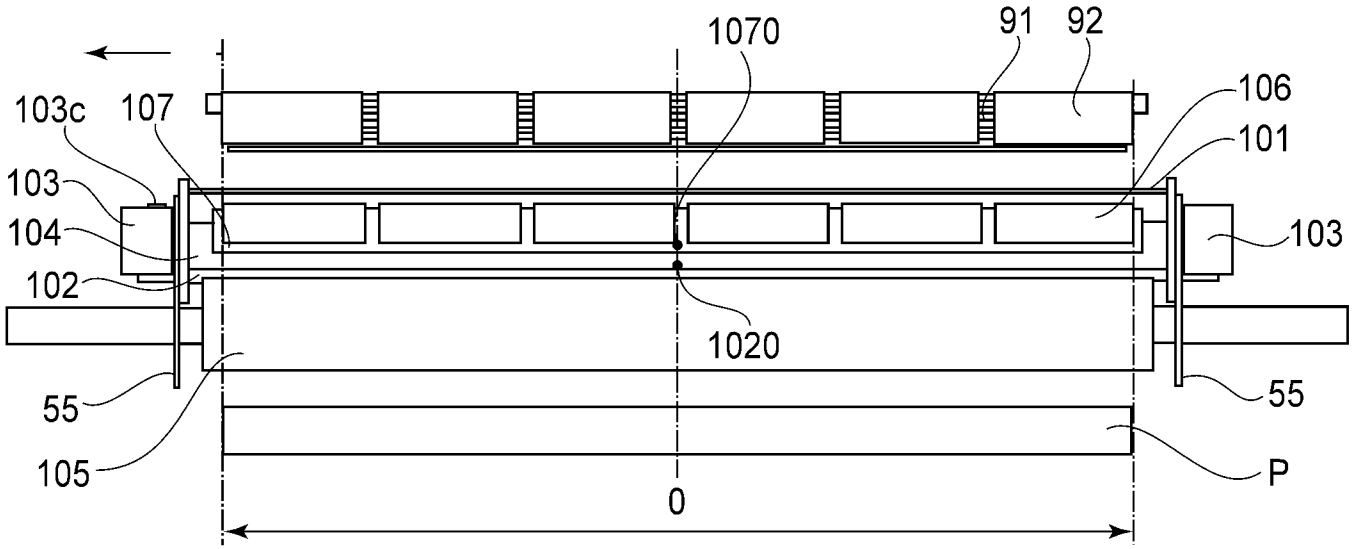
FIG. 15 is a schematic sectional view of a fixing device in accordance with the prior art, at a plane parallel to the lengthwise direction of the fixing device.
Figure 16:
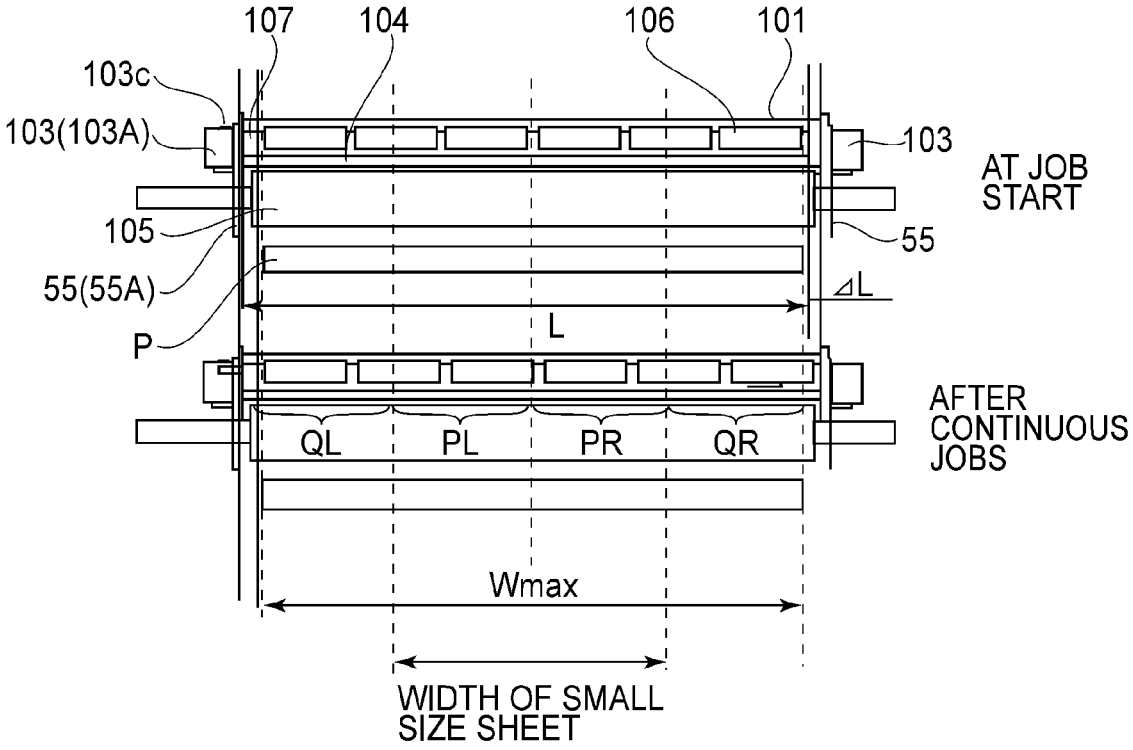
FIG. 16 is a combination of a schematic sectional view of the fixing device in accordance with the prior art, at the beginning of a job, and a schematic side view of the fixing device in accordance with the prior art, after the substantial increase in the temperature of the core, at a plane parallel to the lengthwise direction of the fixing device, and is for showing the "cold offset", from which the fixing device in accordance with the prior art suffers.

FIG. 13 is a perspective view of the fixing device (minus fixation belt 101) in this embodiment, and FIG. 14 is a combination of a schematic exploded sectional view of the fixing device in this embodiment (minus fixation belt 101) at a vertical plane perpendicular to the recording-medium-conveyance direction, prior to the heating of the fixation belt 101, and a schematic exploded sectional view of the fixing device in this embodiment (minus fixation belt 101) at a vertical plane perpendicular to the recording-medium-conveyance direction, after the conveyance of a substantial number of sheets of recording medium through the fixing device. Referring to FIG. 13, the excitation coil 91 which is a magnetic field generating means is held within the holder 93, which is formed of heat resistant resin. The outside magnetic core 92 also is held within the holder 93, and is on the outward side of the excitation coil 91. The heat resistant resin as the material for the holder 93 in this embodiment is the same as the heat resistant resin as the material for the core supporting member 107. The holder 93 is attached to the top plate 94, which is made of a metallic substance. The top plate 94 is supported by the fixation belt unit 110 by its lengthwise ends. The portion 103*b* of the flange 103 of the fixation belt unit 110 is fitted in the groove 94*a* of the left side plate 94A of the top plate 94.

The holder 93 is provided with a positioning portion 93*a*, which corresponds in position to the centerline O of the recording-medium passage. The positioning portion 93*a* is fitted in the positioning hole 94*c* with which the top plate 94 is provided. Thus, the holder 93 is positioned so that its lengthwise center remains aligned with the lengthwise center of the fixing device.

On the other hand, the top plate 96 is attached to the positioning portion 103*b* of the portion 103A of the flange 103. Therefore, the position of the top plate 94 is controlled by its side wall 94A. In this embodiment, the position of the top plate 94 is controlled by the stay 104 through the portion 103A of the flange 103. However, the fixing device may be structured so that the position of the top plate 94 is directly controlled by the stay 104.

Next, the thermal expansion of the top plate 94 and holder 93 in the lengthwise direction of the fixing device in this embodiment, which is similar to the thermal expansion of the counterparts in the first embodiment is described as in the first embodiment, is described.

The materials of the top plate 94 and holder 93, their coefficient of thermal expansion, and the amount of thermal expansion calculated with the use of Equation (1), are summarized in Table 2. It is assumed here that their positions are controlled with reference to one of the lengthwise ends of the fixing device, and L=400 mm; T=200° C.; and T0=20° C.

TABLE 2

| | Material | Coefficient of linear thermal expansion a (1/K) | Thermal expansion amount ΔL |
|---|---|---|---|
| Top plate 94 | Steel | 1.1 × 10^−5 | 0.79 mm |
| Holder 93 | PPS | 6.0 × 10^−5 | 4.32 mm |

As is evident from Table 2, the holder 93 is five times larger in the amount of thermal expansion than the top plate 94. Thus, if the fixing device is structured so that the position of the holder 92 relative to the top plate 94 is controlled with reference to only one of the lengthwise ends of the fixing device (one of side walls of top plate 94), the thermal expansion of the holder 93 makes the holder 93 asymmetrical with reference to the recording medium conveyance passage centerline O.

In this embodiment, therefore, in order to solve the above described problem of the asymmetrical thermal expansion of the holder 93, the holder 93, which is significant in the amount of thermal expansion in the lengthwise direction of the fixing device, is attached to the center (94*c*) of the top plate 94, which corresponds in position to the centerline of the recording-medium conveyance passage. With the employment of this structural arrangement, the holder 93 symmetrically expands with reference to the centerline O of the recording-medium conveyance passage, in terms of the lengthwise direction.

Referring to FIG. 14, therefore, even after the conveyance of a substantial number of sheets of recording medium through the fixing device, the holder 93 remains far less asymmetrical with reference to the centerline O of the recording-medium conveyance passage than the holder (93) of any fixing device in accordance with the prior art. Therefore, the outside magnetic core 92 which is supported by the holder 93 and is responsible for the temperature distribution of in the fixation nip N remains far less asymmetrical with reference to the centerline O of the recording-medium conveyance passage than the counterpart of any fixing device in accordance with the prior art. Therefore, the fixing device in this embodiment is unlikely to suffer from the problem that the portion of its fixing member, which corresponds in position to one of the two areas of the recording-medium conveyance passage which are outside the recording medium path when a sheet of recording medium which is narrower than the widest sheet of recording medium usable with the fixing device is used as the recording medium, excessively increases in temperature, and therefore, suffers from thermal damage, or the problem that the portion of its fixing member, which corresponds in position to one side of the recording-medium passage with reference to the centerline O of the passage, excessively decreases in temperature, and causes thereby the "cold offset".

(Modification of Preceding Preferred Embodiments)

The various arts in the preceding preferred embodiments of the present invention described above may be employed in combination to realize an image heating device in accordance with the present invention. For example, the backup member 102 in the third embodiment may be attached to the stay 104 so that its center coincides with the center of the stay 104 in terms of the lengthwise direction, and the excitation coil 91 in the fourth embodiment may be attached to the stay 104 so that its center coincides with the center of the stay 104 in terms of the lengthwise direction.

As described above, according to the present invention, it is possible to provide an image heating device which is significantly smaller in the temperature difference created between one side of its fixing member and the other, in terms of the lengthwise direction of the image heating device, by the thermal expansion of the resin of which the member for supporting magnetic cores is formed, than any fixing device in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 278187/2010 filed Dec. 14, 2010, which is hereby incorporated by reference.

What is claimed is:

1. An image heating apparatus comprising:

an excitation coil;

an image heating member configured to generate heat using a magnetic flux from said excitation coil to heat an image on a recording material;

a magnetic core provided inside said image heating member configured to guide the magnetic flux to said image heating member;

a core supporting member of resin material contacting said magnetic core to support said magnetic core;

a back-up member contacting an inner surface of said image heating member;

a pressing member forming a nip between said back-up member and itself with said image heating member therebetween;

a stay member composed of metal, provided inside said image heating member, configured to press said back-up member to form a nip;

an apparatus side plate provided at each of opposite ends with respect to a rotational axis direction of said image heating member;

a first positioning portion configured to determine a position of said stay member relative to one of said apparatus side plates; and a second positioning portion, provided at a central portion of said stay member, configured to determine a position of said core supporting member relative to said stay member, wherein said stay member is more distant from said coil than said core supporting member.

2. An apparatus according to claim 1, further comprising a positioning portion configured to position said back-up member relative to said stay member in a central portion with respect to the rotational axis direction.

3. An apparatus according to claim 1, further comprising a positioning portion configured to position said excitation coil relative to said stay member in a central portion with respect to the rotational axis direction.

4. An apparatus according to claim 1, wherein an outer magnetic core is provided in a side of said excitation coil remote from said magnetic core.

5. An apparatus according to claim 1, wherein said excitation coil is divided in the rotational axis direction.

6. An apparatus according to claim 1, wherein said stay member is disposed out of contact with said magnetic core.

7. A fixing apparatus comprising:

first and second rotatable members configured to heat fix a toner image on a recording material at a nip portion therebetween;

an excitation coil provided outside of said first rotatable member and configured to generate a magnetic flux for electromagnetic induction heating of said first rotatable member;

a magnetic core provided inside of said first rotatable member and configured to direct the magnetic flux to said first rotatable member;

a core holder configured to hold said magnetic core, said core holder being made of resin material;

a pressing pad provided inside of said first rotatable member and configured to press said first rotatable member toward said second rotatable member to form the nip portion;

a metal member provided inside of said first rotatable member and configured to back up said pressing pad to form the nip portion; and a metal plate provided so as to oppose to a longitudinal end portion of said first rotatable member and configured to position a longitudinal end portion of said metal member, wherein said core holder is mounted on a surface of said metal member which is opposed to said excitation coil so that said core holder is positioned at a positioning portion of said metal member which is substantially aligned with a central portion of a recording material passing area in the longitudinal direction.

8. An apparatus according to claim 7, wherein said core holder includes a projection portion, said metal member includes a hole portion formed at the positioning portion, said core holder is positioned through an engagement of said projection portion with said hole portion.

9. An apparatus according to claim 7, further comprising a regulating portion provided so as to oppose one longitudinal end portion of said first rotatable member and configured to regulate a movement of said first rotatable member in the longitudinal direction, wherein said metal member is mounted on said metal plate through said regulating portion.

10. An apparatus according to claim 7, wherein said core holder holds a plurality of said magnetic cores arranged in the longitudinal direction.

11. An apparatus according to claim 7, further comprising an outer magnetic core provided so as to oppose to said first rotatable member through said excitation coil.

12. An apparatus according to claim 7, further comprising another metal plate provided so as to oppose the other longitudinal end portion of said first rotatable member and configured to support said metal member.

13. An apparatus according to claim 12, further comprising a regulating portion provided so as to oppose to the other longitudinal end portion of said first rotatable member and configured to regulate a movement of said first rotatable member in the longitudinal direction, wherein said metal member is mounted on said another metal plate through said regulating portion.

* * * * *